US005240194A

United States Patent [19]

Noirot et al.

[11] Patent Number: 5,240,194

[45] Date of Patent: Aug. 31, 1993

[54] APPARATUS FOR CONTROLLING THE TENSION OF A WIRE FED TO A WINDING MACHINE

[75] Inventors: Jacques G. P. Noirot, Annemasse; Pascal Bultel, Thonon Les Bains, both of France

[73] Assignee: Prosys S.A. Z.A.E. Findrol, Fillinges, France

[21] Appl. No.: 632,110

[22] Filed: Dec. 20, 1990

[30] Foreign Application Priority Data

Dec. 20, 1989 [FR] France ..... 89 17204

[51] Int. Cl.[5] ..... B65H 59/00; B65H 23/18

[52] U.S. Cl. ..... 242/45; 226/24; 226/42

[58] Field of Search ..... 242/45, 75.51, 155 R, 242/155 M; 226/24, 27, 42, 44

[56] References Cited

U.S. PATENT DOCUMENTS 3,713,009 1/1973 Poppinger et al. ..... 242/75.51 X
4,011,976 3/1977 Greer ..... 226/42 X
4,129,238 12/1978 Herd ..... 226/44 X
4,420,123 12/1983 Fox et al. ..... 242/45 X
4,480,799 11/1984 Yano et al. ..... 242/45 X
4,708,301 11/1987 Kataoka ..... 242/75.51
5,039,027 8/1991 Yanagihara et al. ..... 242/75.51 X
5,045,134 9/1991 Schenker et al. ..... 226/24 X

*Primary Examiner*—Daniel P. Stodola
*Assistant Examiner*—Michael R. Mansen
*Attorney, Agent, or Firm*—Collard & Roe

[57] ABSTRACT

An apparatus having a drive pulley around which the wire is rolled, driven by a motor coupled to a speed control element. The pulley is provided with a tachometer which generates a signal proportional to the speed of movement of the wire. An extensometer, coupled to the wire, generates a signal, representative of a predetermined, ideal tension in the wire, which is compared with a set value. The resulting signal is superimposed on the tachometer signal to generate a signal to control the control element. The apparatus may also be provided with a spring biased oscillating arm located after the extensometer that has a pulley on one end, over which the wire passes. Also, a coding wheel may be provided after the oscillating arm assembly which generates a signal proportional to the speed of the wire. The coding wheel signal is converted to a signal representative of a variation in tension of the wire. The preset ideal value is established by subtracting the converted signal from a second set value, corresponding to an ideal variation in the tension of the wire.

4 Claims, 4 Drawing Sheets

APPARATUS FOR CONTROLLING THE TENSION OF A WIRE FED TO A WINDING MACHINE

BACKGROUND OF THE INVENTION

The present invention relates to the field of winding insulated wire onto bobbins or cores, especially for electric coils. More particularly, it relates to a reel for automatically regulating the tension of the insulated wire to feed a winder, specifically, from a supply.

It is understood that the quality of core winding is dependent on a constant mechanical tension being exerted on the insulated wire while it is being wound onto the body of the core. This applies even though the speed of the wire can fluctuate, as a function of various factors, particularly the shape of the core, whether it is round, square, rectangular, et cetera. Other factors include the increasing diameter of winding during the operation, and various movements of the guide element for the wire which is associated with the winder. These factors may result in wire movement in the reverse direction under certain conditions.

Therefore, attempts have been made to make the mechanical tension of the wire independent of its speed of movement, by using of appropriate mechanical or electronic reels. These reels known in the state of the art, however, have major disadvantages, which will be presented below, particularly with regard to recovery or back-spooling in case of temporary wire movement in the reverse direction.

SUMMARY OF THE INVENTION

It is therefore an object of the present invention to eliminate the aforementioned drawbacks of the prior art and to provide a wire reel with automatically regulated tension, which also has automatic back-spooling.

These and other related objects are attained according to the invention by a reel having a drive pulley around which the wire rolls after leaving the supply. A motor is provided which drives the pulley. The wire then passes through an extensometer which delivers an electronic signal representative of the actual tension in the wire. A tachometer measures the speed of the wire at the drive pulley. The tension is then compared to a set value, corresponding to a predetermined ideal tension the result being added to the tachometer signal. The sum then acts on a speed control element which controls rotation of said motor, thereby bringing the tension of said wire to a value corresponding to the set value.

The extensometer preferably includes a pulley assembly, through which the wire passes. The extensometer can then, optionally, deliver an electronic signal representative of twice the actual tension in the wire.

Advantageously, the reel can also include a pulley following the extensometer mounted at the end of an oscillating arm, biased by a spring against the wire.

It is desirable to provide a coding wheel, following the pulley and oscillating arm, which delivers an electronic signal proportional to the speed of the wire. Ideally, this signal can be processed to produce another electronic signal representative of a variation in the tension of the wire. This value is subtracted from a second set value corresponding to a predetermined ideal variation in tension to produce the set value discussed above.

Other objects and features of the present invention will become apparent from the following detailed description, considered in connection with the accompanying drawings which disclose the embodiments of the invention. It is to be understood, however, that the drawings are designed for the purpose of illustration only, and not as a definition of the limits of the invention.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
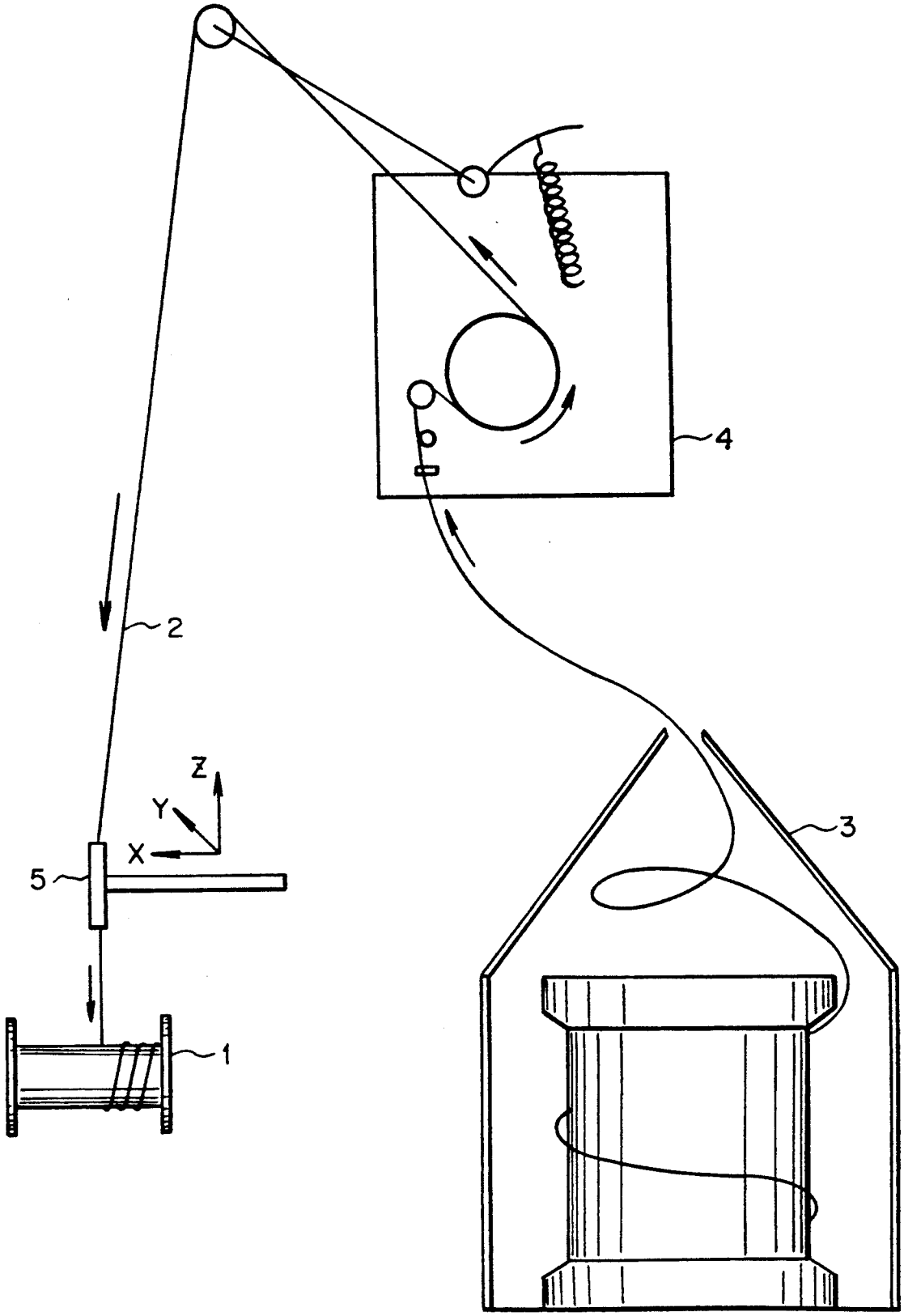
FIG. 1 (PRIOR ART)
FIG. 1 is a schematic diagram showing the prior art.

Referring now in detail to the drawings and, in particular, FIG. 1, there is illustrated a back-spooling reel with a wire 2 coming from a supply 3 passing through a reel 4 which feeds a winder. Table XYZ is equipped with a guide element 5, wire 2 being wound around a core 1. Reel 4 can be of any known type, particularly those mentioned below.

Figure 2:
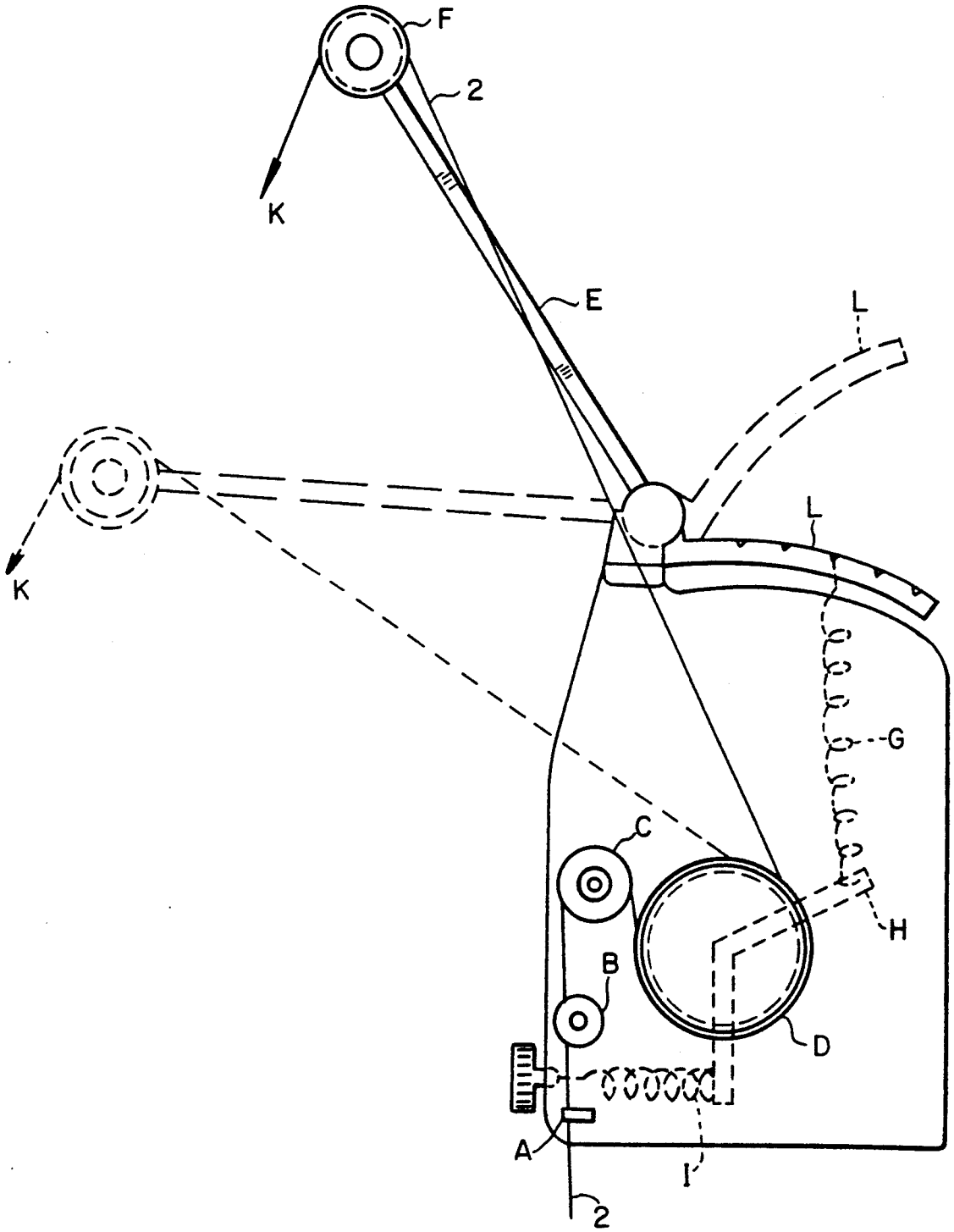
FIG. 2 (PRIOR ART)
FIG. 2 is a schematic diagram showing a known mechanical reel.

In FIG. 2, a reel of the type known from the state of the art is shown schematically. Wire 2 coming from the supply passes into a centering ring A, is pressed between a pair of felt friction rollers B, and after a return C, comes to be rolled around the groove of a pulley D, equipped with a mechanical brake of any type, and shown as a lever H. The pressure exerted by rollers B on wire 2 causes tension in wire 2, which allows wire 2 to be held in place in the groove of pulley D. Leaving pulley D, wire 2 goes past a pulley F mounted on an articulated arm E, before going to the winder, specifically at K. Arm E is impelled towards a position of rest by a spring G, which acts on brake H. During the movement of wire 2, the tension on the latter brings lever E into the work position (shown in broken lines), and pulls on spring G, which releases brake H.

Pre-regulation of brake H is mechanically, manually carried out by a spring I associated with a setting element J. Furthermore, the work position of arm E, relative to brake H, can be regulated by the displacement of the point of attachment of spring G on a notched lever L which is part of arm E. When wire 2 is pulled towards the winder at K, arm E swings into its work position, which releases brake H. When the tension on the wire is sufficient, pulley D starts to turn against brake H, and permits the departure of the thread at K. The tension of the wire is therefore, at least partially, automatically regulated by the equilibrium of arm E acting on brake H.

As can be seen, this mechanical device requires manual adjustment, which thus requires the permanent presence of an operator. Furthermore, when the speed of movement of thread 2 increases, the effectiveness of brake H also increases, and the force exerted by spring G must also increase, which means that the tension of wire 2 increases with the speed. Also, at high speed, heating and wear of brake H become major factors, and translate into a drop in control values and into premature wear of these parts. This causes the device to chatter or to vibrate. On the other hand, the device loses effectiveness when cold.

It should also be noted that back-spooling of wire 2 is limited to the difference in length resulting from the return of arm E towards its position of rest. This also acts as a wire reservoir. During back-spooling, however, there is no control at all of the tension wire 2.

Figure 3:
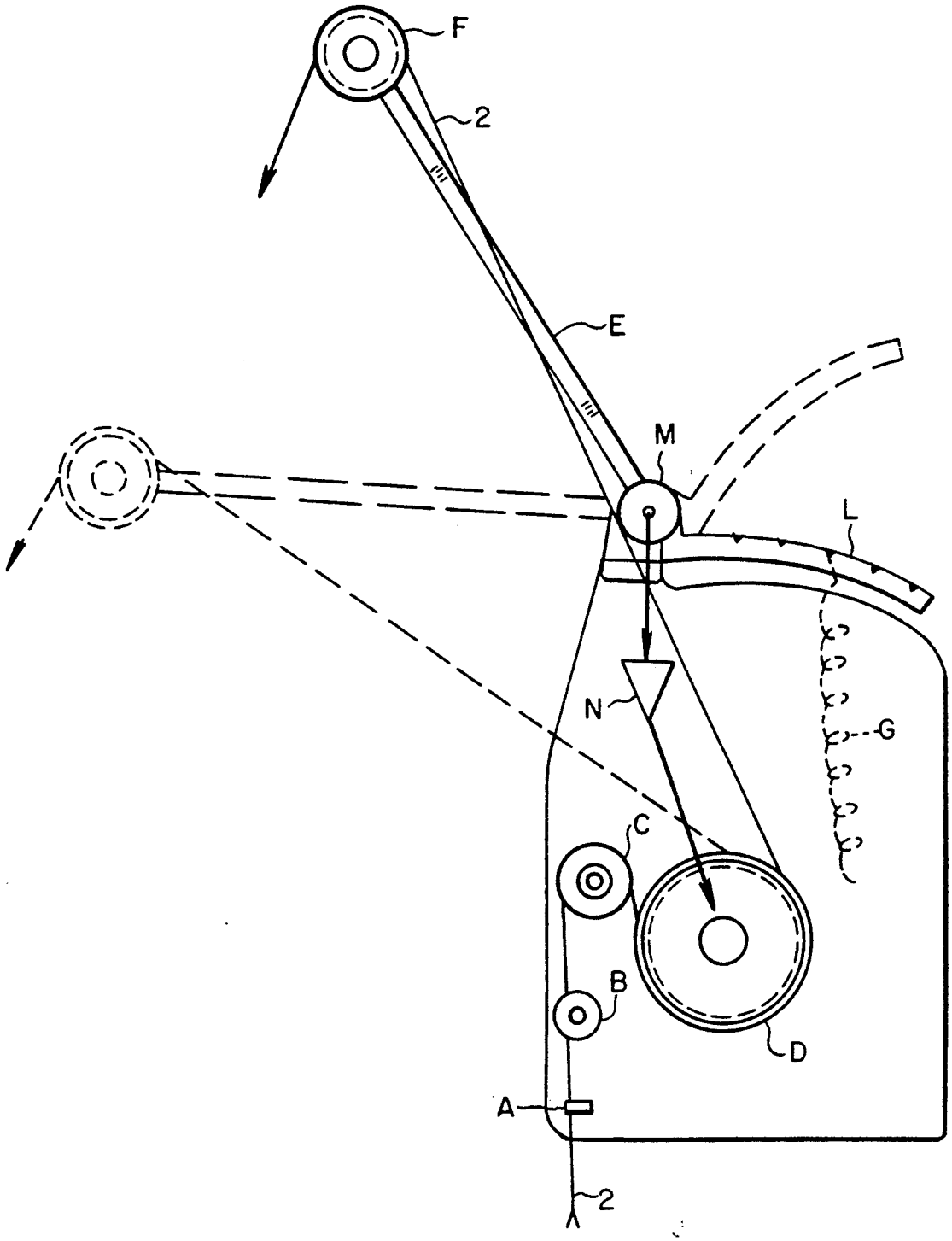
FIG. 3 (PRIOR ART)
FIG. 3 is a schematic diagram showing a known electromechanical reel.

A purely mechanical improvement of these devices is brought about by the use of an electromechanical reel, where an electrical brake is used. Such a known device is illustrated in FIG. 3. The method of operation is analogous to the preceding, except for the following: a potentiometer M which transforms the mechanical information of the position arm E, into electrical information, is associated with articulated arm E. This electrical information, after amplification at N, is applied to an electrical brake (not shown) associated with the pulley D. Spring G urges arm E back into its rest position. However, in this instance, arm E operates independently of brake D. The force of spring G may be adjusted by attaching it to various points along lever L.

When arm E is at rest, the information from potentiometer M, after amplification at N, is applied to the electrical brake to obtain maximum braking. When wire 2 is pulled at K, the arm E swings down and the effectiveness of the brake is reduced, until the pulley D can be brought into rotation to deliver thread at K. The adjustments are mechanical, by means of spring G, and electrical, by adjustment of the gain of amplifier N.

While such a device represents a certain amount of progress over the mechanical reels mentioned above, there is, however, still a major problem of back-spooling. As in the preceding case, even with the improvements described, back-spooling takes place without the tension being controlled.

The present invention aims to eliminate these disadvantages of the state of the art which have just been mentioned.

Figure 4:
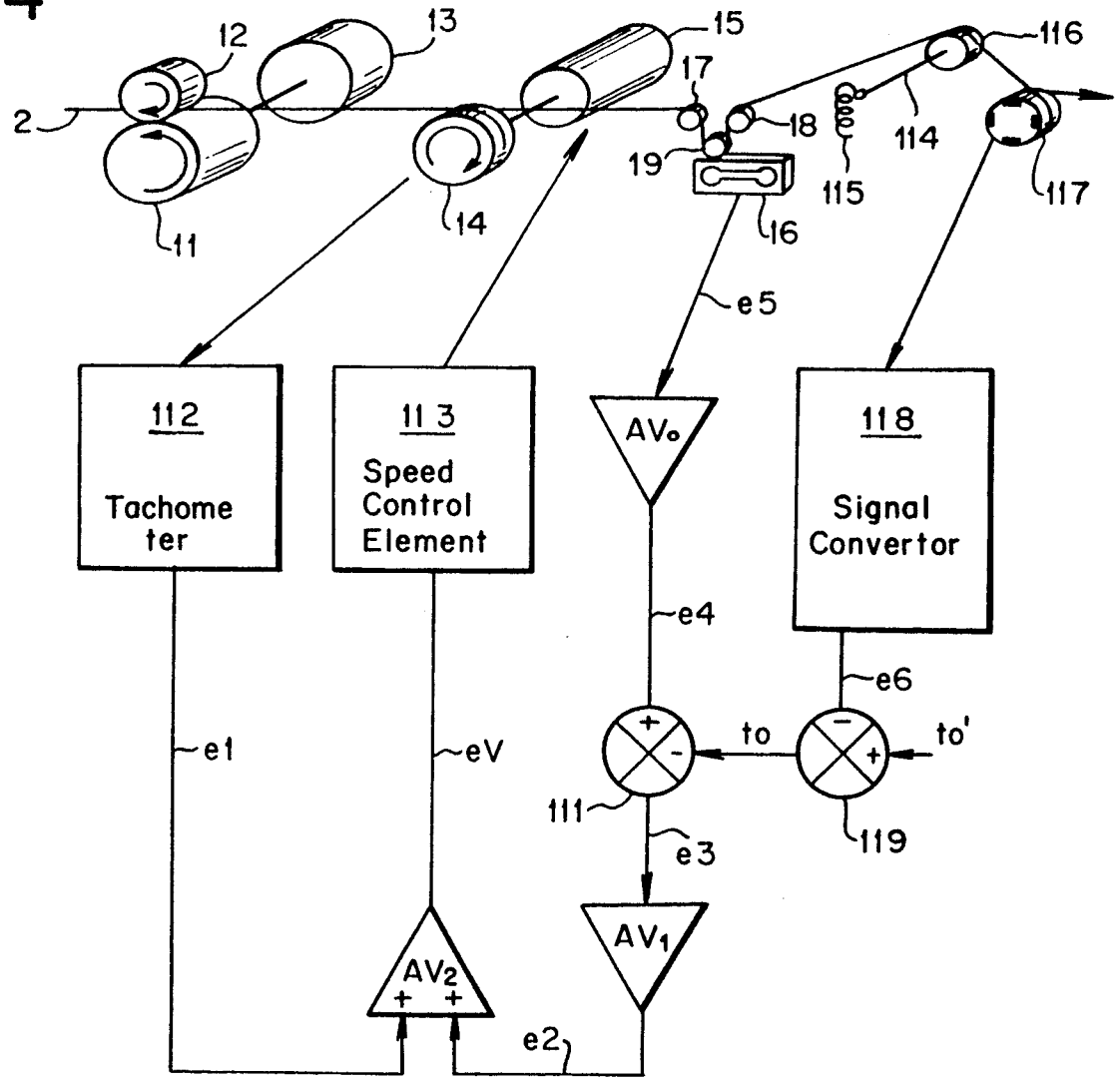
FIG. 4 is a schematic diagram of a back-spooling reel embodying the present invention.

An embodiment of a reel according to the invention is illustrated schematically in FIG. 4.

Wire 2, which comes from a supply, not shown, first passes between a pair of rollers covered with felt 11, 12, one of which is driven in the opposite direction to the movement of the wire by a synchronous motor 13. The second roller 12 is a simple presser roller driven by friction by roller 11. This arrangement of rollers 11, 12 causes slight residual tension in wire 2, which holds it at the bottom of the groove of a pulley 14, in which it makes a complete turn. Pulley 14 is driven by an electrical motor 15, which can rotate in both directions. Wire 2 is held against the groove of pulley 14 under added tension during back-spooling when motor 15 is operating in reverse. Motor 15 is controlled by a control loop, which will be discussed in greater detail below.

Leaving pulley 14, wire 2 passes through a tension measurement device which comprises two pulleys 17 and 18 with low inertia, on opposite sides of an intermediate pulley 19. Intermediate pulley 19 is associated with an extensometer 16, for example a deformation gauge. Due to this pulley arrangement, extensometer 16 detects twice the actual tension to which wire 2 is subjected. The electrical tension signal produced is used as described below.

Wire 2 can then leave towards the winder.

In a further advantageous embodiment, wire 2 can pass over a pulley 116 with low inertia, mounted on a pivoted arm 114. Arm 114 presses against wire 2 due to biasing by a spring 115. The swing of arm 114 against spring 115 makes it possible to mechanically absorb any jolts which might be due to a defect in extraction of the thread from the supply bobbin, before the electromechanical elements have time to react. The pulley assembly 17, 18 and 19 can also absorb jolts during accidental pinching of the thread, by the core seams, for example, during winding of the wire onto the core.

According to yet a further preferred embodiment, wire 2 makes a turn on a pulley equipped with a coding wheel 117 before leaving towards the winder. This wheel produces signals with a frequency proportional to the speed of wire movement, produced and used as mentioned below.

The speed of rotation of the pulley 14 is measured by a tachometer 112 which delivers a signal e1. The signal e5 coming from the extensometer 16 is amplified at AVo and injected (i.e., in the form of e4), into a differential stage 111 which furthermore receives a signal t0 which represents the set value for the wire tension.

The signal resulting from this difference, i.e. e3, is amplified at AV1 to be added (i.e. now in the form of the signal e2) to the signal e1 from the tachometer, and the result, after amplification at AV2, is sent (i.e., in the form of the signal ev) to a control element 113 which controls the speed of rotation of motor 15, to bring about equilibrium between the signal e5 of the extensometer and the set value signal t0, in other words to compensate for any variation which occurs in the tension of the wire relative to the set value represented by the signal t0.

This arrangement makes it possible to better regulate the tension of the wire to be wound onto cores than according to the technique previously known, and therefore to improve the finished product, i.e. the finished coils.

However, in studying high speeds of production, it is found that by increasing the speed of wire movement, there may be a significant effect on the tension of the wire, and therefore on the quality of the finished product.

In order to eliminate these limitations, the invention furthermore proposes to intervene in the set value tension t0 sent to the differential stage 111 mentioned above. It is particularly advantageous at this stage that the coding wheel or pulley 117, mentioned previously as an optional element, intervenes.

For this embodiment of the invention, it is useful to reference the material mentioned above.

Coding wheel 117, around which wire 2 is now rolled, produces frequency signals representative of the speed of movement of wire 2, as already stated.

As stated above, signal e5 emitted by extensometer 16 represents twice the tension t of the wire, with a coefficient of proportionality c, i.e. $e5=2\ ct$.

Furthermore, the speed V of movement of wire 2 is proportional to that of motor 15 with a factor of $\pi d$, d being the diameter of pulley 14, which gives the following equation for the tachometer signal $e1=bV/\pi d$, b being the coefficient of proportionality of tachometer 112. Furthermore, the signal ev for control of motor 15 is expressed as $ev=V/\pi da$, a being the coefficient of proportionality of control element 113 for the speed of rotation of motor 15.

Taking into account the factors AVo, AV1 and AV2 and the intermediate expressions of signals e4 and e3, it is seen that signal e2 injected into the amplifier adder AV2 is expressed by $e2=V(1-ab.AV2)/\pi d.a.AV2$. This expression shows that it is necessary that a.b.AV- 2<1, since if this is not true, the control circuit becomes oscillating and no longer satisfies the requirements for exercising the control function for which it is provided.

As can be seen, the tension t of wire 2 as function of the set value tension t0 is expressed by:

$$t = \frac{t0}{2c \cdot AV0} + V(1 - abAV2)/2\pi d \cdot acAV0 \cdot AV1 \cdot AV2.$$

At a speed of wire movement V which is zero, for example during a stop, or before back-spooling, whichever the case may be, we have t=t0/2cAVo, therefore, when V which is non-zero, a difference in tension of the thread relative to t0 corresponds to the following expression:

$$\Delta t = (1 - abAV2)V/2a\pi cdAVo.AV1.AV2$$

this difference or error being independent of the value t0.

If one wishes to maintain constant mechanical tension on the wire while it is moving, it is necessary to make a correction in the signal eV and therefore, upstream, in the signal e3 which comes from the extensometer 16 after injection of the set value t0.

According to the invention, this correction is made starting from coding wheel 117. Coding wheel 117 delivers signal with a frequency proportional to the speed V of movement of the wire, which, after processing by a signal convertor 118, the parameters of which are adapted to those of the elements already utilized, delivers a signal e6 which is expressed by:

$$e6 = 2cAVo.\Delta t.$$

This signal e6 is sent into a subtractor 119 where e6 is subtracted from set value signal t0' the difference, t0, is supplied to differential stage 111 as mentioned above.

It is therefore seen that the tension of the wire is expressed by:

$$t = \Delta t + (t0' - e6)/2cAVo, \text{ i.e. } t = t0'/2cAVo,$$

the tension of the wire, does not depend on the speed V of movement of the wire, but only on the injected set value t0' and the parameters which are fixed. These parameters are fixed by electronic means for measurement and processing of the corresponding signals.

Thus, at high speeds of wire movement V, it is possible to use the coding wheel 117 and the control which results from it to make the tension of the wire independent of its speed of movement V. Such a relationship guarantees the quality of the finished product, i.e. the finished coils.

While only a few embodiments of the present invention have been shown and described, it is obvious that many changes and modifications may be made thereto without departing from the spirit and scope of the invention.

What is claimed is:

1. An apparatus for controlling the tension of a wire fed to a winding machine from a supply, comprising:

a drive pulley around which the wire rolls after leaving the supply;

a motor for driving said drive pulley;

a speed control element coupled to said motor for adjusting the speed of said motor;

an extensometer for receiving the wire after leaving said drive pulley, for measuring the tension in the wire and generating a first electronic signal corresponding to the tension of the wire;

a tachometer coupled to said drive pulley for measuring the speed of movement of the wire at said drive pulley, and generating a second electronic signal proportional to the speed of movement of the wire;

first means for comparing said first electronic signal with a first preset value signal, corresponding to a predetermined ideal tension in the wire, and generating a third electronic signal which when added to said second electronic signal generates a fourth electronic signal which acts on said speed control element and the speed of the wire, so as to adjust the tension of the wire to a value corresponding to the ideal tension;

an oscillating arm with a free end and a pulley mounted on said free end of said arm for receiving the wire after leaving said extensometer; and a coding wheel located after said oscillating arm and said pulley, the wire passing around said coding wheel before leaving the apparatus, said coding wheel generating a fifth electronic signal with a frequency proportional to the speed of the wire.

2. The apparatus according to claim 1, further comprising:

means for converting said fifth electronic signal to generate a sixth electronic signal representative of a variation in the tension of the wire.

3. The apparatus according to claim 2, further comprising:

subtraction means for subtracting said sixth electronic signal from a second preset value signal, corresponding to an ideal variation in the tension of the wire, so as to generate said first preset value signal.

4. An apparatus for controlling tension of a wire fed to a winding machine from a supply, comprising:

a drive pulley around which the wire rolls after leaving the supply;

a motor for driving said drive pulley;

a speed control element coupled to said motor for adjusting the speed thereof;

an extensometer which includes a pulley assembly through which the wire passes after leaving said drive pully, for measuring the tension in the wire and generating a first electronic signal corresponding to twice the tension of the wire;

a tachometer coupled to said drive pulley for measuring the speed of movement of the wire at said drive pulley, and generating a second electronic signal proportional to the speed of movement of the wire;

first means for comparing said first electronic signal with a first preset value signal, corresponding to a predetermined ideal tension in the wire, to generate a third electronic signal which when added to said second electronic signal generates a fourth electronic signal which acts on said speed control element and the wire speed to adjust the tension of the wire to a value corresponding to the ideal tension;

an arm with a free end and a pulley mounted on said free end of said arm for receiving the wire after leaving the extensometer;

a spring for biasing said arm to tension the wire;

a coding wheel located after said arm and its pulley, the wire passing around said coding wheel before leaving the apparatus, said coding wheel generating a fifth electronic signal with a frequency proportional to the speed of the wire;

means for converting said fifth electronic signal to a sixth electronic signal representative of a variation in said tension of said wire; and subtraction means for subtracting said sixth electronic signal from a second preset value signal, corresponding to an ideal variation in said tension of the wire for generating said first preset value signal.

* * * * *